US006881056B2

(12) United States Patent
Simonds

(10) Patent No.: US 6,881,056 B2
(45) Date of Patent: Apr. 19, 2005

(54) COMBUSTION HEATER

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 113 days.

(21) Appl. No.: 09/639,198

(22) Filed: Oct. 15, 2002

(65) Prior Publication Data

US 2004/0214122 A1 Oct. 28, 2004

(51) Int. Cl.[7] ..... F23D 11/04

(52) U.S. Cl. ..... 431/168; 431/207; 431/354; 239/214.11

(58) Field of Search ..... 431/207, 28, 168, 431/117, 169, 354, 350, 210; 60/743, 744, 745; 239/214.11–214.21; 604/408, 905, 326, 533, 339; 422/61, 99; 206/370, 363–66, 69; 220/62.22; 383/210.1; 128/912; 138/96; 285/45, 53

(56) References Cited

U.S. PATENT DOCUMENTS 2,620,864 A * 12/1952 Vida et al. ..... 431/168
2,738,837 A * 3/1956 McGillis et al. ..... 431/264
3,508,852 A * 4/1970 Hourwitz et al. ..... 431/168
3,980,415 A * 9/1976 Miyahara ..... 431/168
4,113,416 A * 9/1978 Kataoka et al. ..... 431/1
4,813,865 A * 3/1989 Miyahara ..... 431/168
5,816,789 A 10/1998 Johnson
5,961,310 A 10/1999 McClure
6,024,549 A 2/2000 Lee

FOREIGN PATENT DOCUMENTS

JP 57-139213 * 8/1982 ..... 431/168

* cited by examiner

*Primary Examiner*—James C. Yeung
(74) *Attorney, Agent, or Firm*—Brett Trout

(57) ABSTRACT

A combustion heater comprising an induction chamber provided with an inlet, a combustion chamber in fluid communication with the inlet of the induction chamber, means for moving an oxydizer from the inlet of the induction chamber to the combustion chamber, a fuel reservoir, a frame defining a fuel passageway, means for moving a fuel from the fuel reservoir through the fuel passageway to the combustion chamber, means in fluid communication with the fuel passageway for shearing a fuel prior to combustion, means in fluid communication with the fuel passageway for heating the fuel prior to combustion, and means for combusting a fuel oxydizer mixture within the combustion chamber.

22 Claims, 3 Drawing Sheets

FUEL TANK
FLUID PUMP
HEAT EXCHANGER
BATTERY

COMBUSTION HEATER

BACKGROUND OF THE INVENTION

1. Field of the Invention

The present invention relates in general to a combustion heater for converting a fuel to heat energy, and, more specifically, to such heater preheating and finely dividing the fuel source to achieve a reduction in flame length, a higher conversion of fuel to heat energy, and less undesirable emission.

2. Description of the Prior Art

Combustion heaters are generally known in the art. The general configuration of such combustion heater includes means for injecting a fuel into a combustion chamber and means for igniting the fuel to produce heat energy. A general drawback of such prior art combustion heaters is a long flame length and an inefficient conversion of fuel to heat energy. The long flame length of prior art combustion heaters necessitates the use of larger boilers to surround the flame to convert circulating water to steam. A larger boiler not only adds to the overall cost of such prior art systems, but also prevents such prior art systems from being used in compact applications.

Additionally, such prior art devices often provide means for spraying fuel as a mist into a combustion chamber to provide more contact between the fuel and an oxidizer, such as ambient oxygen. However, the surface area of the fuel particles is still too large to allow adequate concentration of oxidizer around the fuel to completely combust the fuel. Without an adequate supply of oxidizer, the combustion is inefficient, and a portion of the hydrocarbon fuel is converted into undesirable waste products, such as carbon monoxide.

Prior art combustion heaters, therefore, have numerous disadvantages, including an undesirably long flame length, an inefficient conversion of fuel to heat, and production of undesirable waste products. It would be desirable to provide an improved combustion chamber which more efficiently converts hydrocarbon fuels to water and carbon dioxide, thereby increasing the energy output, and reducing the emission of undesirable waste products. The difficulties encountered in the prior art discussed hereinabove are substantially eliminated by the present invention.

SUMMARY OF THE INVENTION

In an advantage provided by this invention, a combustion heater produces a substantially clean conversion of hydrocarbon fuel to carbon dioxide and water.

Advantageously, this invention provides a combustion hear having a short flame length.

Advantageously, this invention provides a combustion heater capable of use with compact boiler systems.

Advantageously, this invention provides a combustion heater for efficient burning of heavy oils and otherwise undesirable petroleum products.

Advantageously, this invention provide a cost effective and efficient means for disposing of biohazardous materials and other toxins.

Advantageously, this invention provides a combustion heater with a self-cleaning mechanism to clear waste carbon products from the heater.

Advantageously, in a preferred example of this invention, a her is provided, comprising an induction chamber provided with an inlet, a combustion chamber in fluid communication with the inlet of the induction chamber, means for moving an oxidizer from the inlet of the induction chamber to the combustion chamber, a fuel reservoir, a frame defining a fuel passageway, means for moving a fuel from the fuel reservoir through the fuel passageway to the combustion chamber, means in fluid communication with the fuel passageway for shearing a fuel prior to combustion, means in fluid communication with the fuel passageway for heating a fuel prior to combustion, and means for combusting a fuel oxidizer mixture within the combustion chamber.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
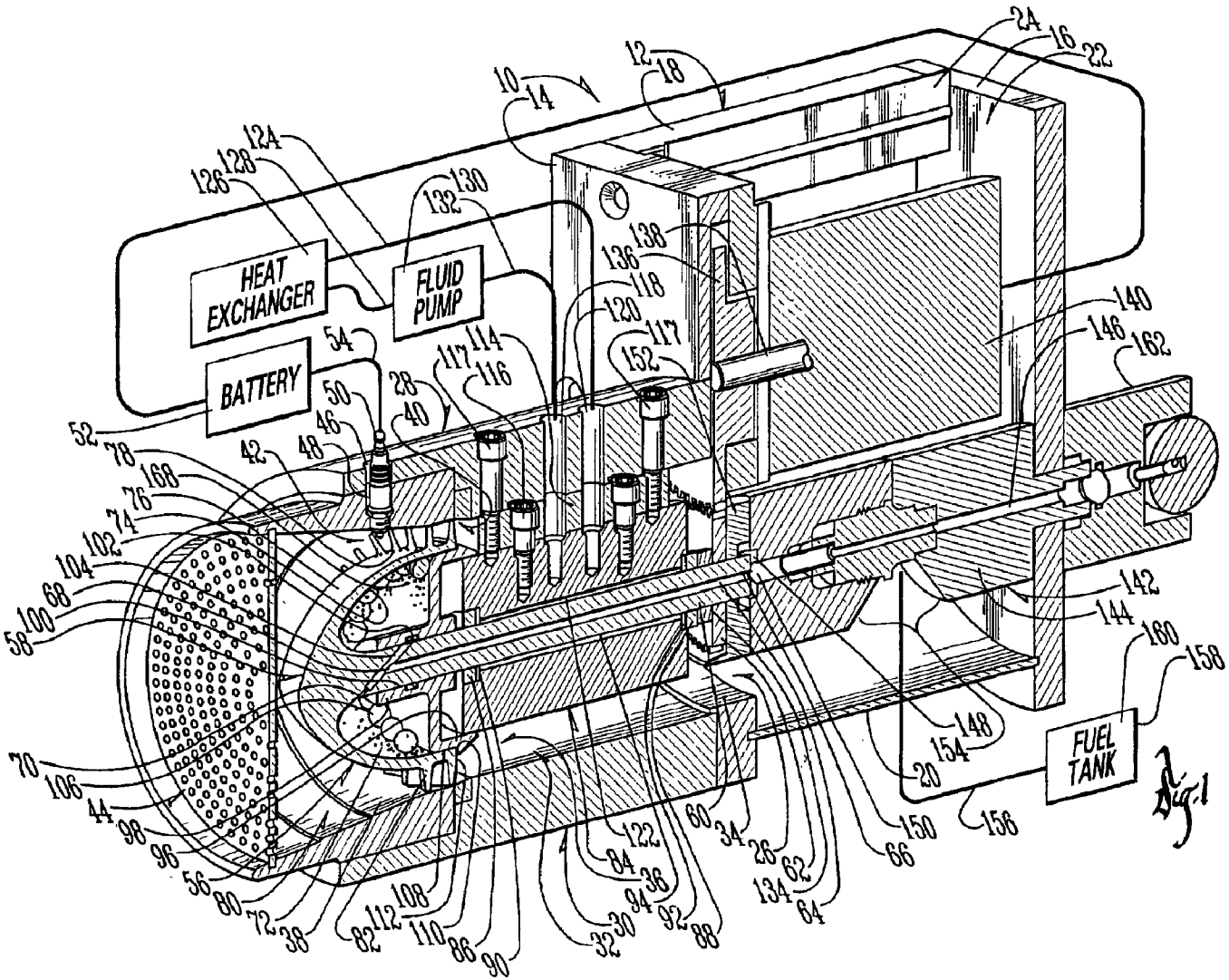
FIG. 1 illustrates an example perspective cross-section of a combustion heater according to this invention.
Figure 2:
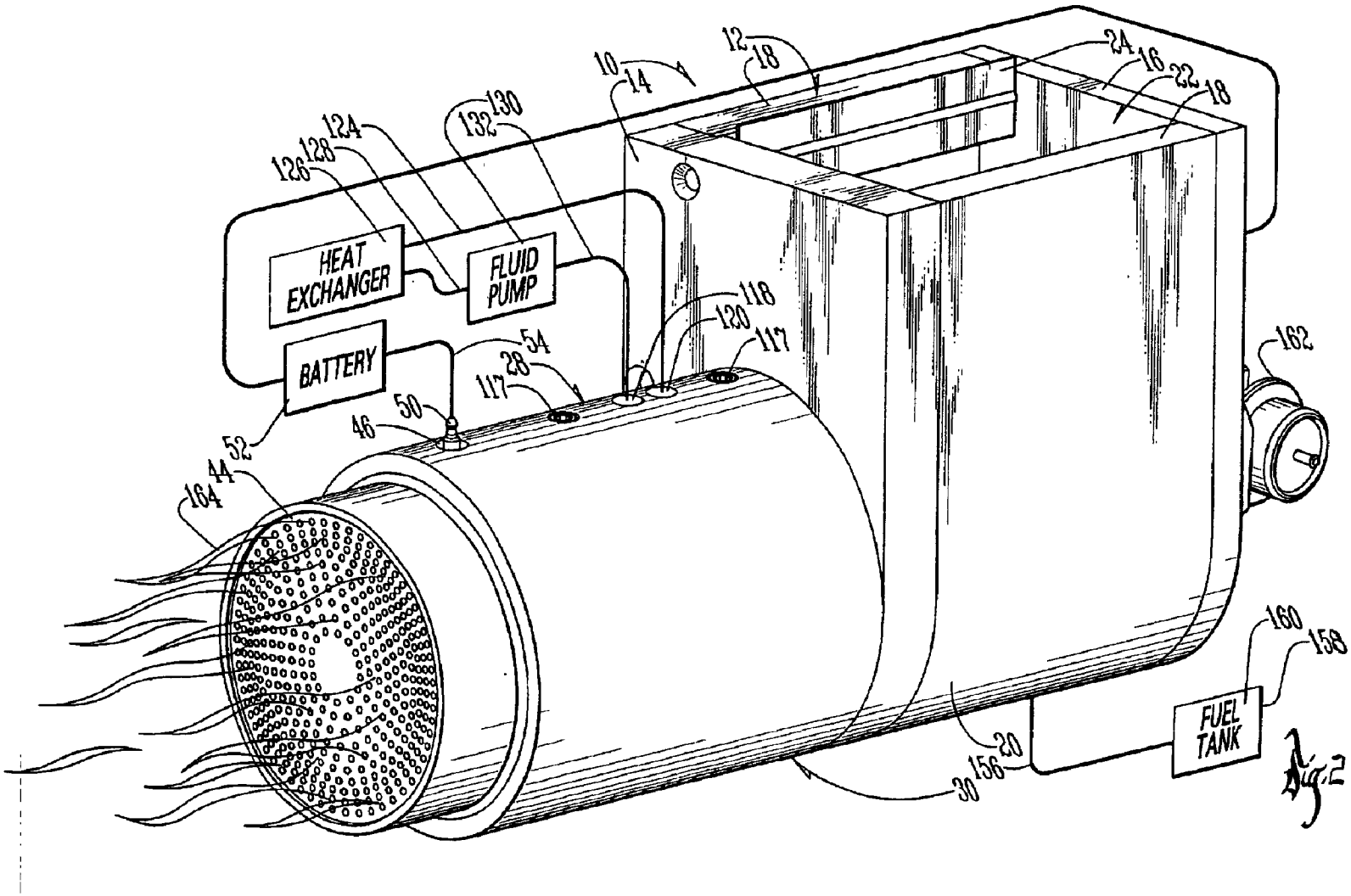
FIG. 2 illustrates a perspective view of the combustion heater of FIG. 1.

Referring to FIG. 1, a combustion heater (10) according to his invention is shown with an induction chamber (12) constructed of a front wall (14), a rear wall (16) and a pair of sidewalls (18). The induction chamber (12) is also provided with a curved floor (20) secured to all four walls, (14), (16), and (18). Although the induction chamber (12) may be of any suitable material, in the preferred embodiment the induction chamber (12) is of aluminum.

The four walls, (14), (16), and (18) define an inlet (22) into the induction chamber (12). Provided over the inlet (22) is a damper (24). In the preferred embodiment, the damper (24) is constructed of a thin sheet of aluminum, pivotally secured to the front wall (14) and rear wall (16) of the induction chamber. The damper (22) is preferably incrementally pivotable between a first position, which allows substantially free flow of air in through the inlet (22), and a second position which substantially prevents the flow of air into the induction chamber through the inlet (22).

The front wall (14) of the induction chamber (12) is preferably provided with an aperture forming an outlet (26) for the induction chamber (12). Secured over the outlet (26) is a cylindrical combustion assembly (28). The combustion assembly (28) includes an outer housing (30) constructed of aluminum. The outer housing (30) defines a flow chamber (32) having an inlet (34) and an outlet (36).

As shown in FIG. 1, the inlet (34) of the flow chamber (32) is secured over the outlet (26) of the induction chamber (12). The outer housing (30) of the combustion assembly (28) is secured to the front wall (14) of the induction chamber by bolts (not shown) or any other suitable connection method known in the art. Secured to the outer housing (30) over the outlet (36) is a burner cone (38). As shown in FIG. 1, the interior of the burner cone (38) is tapered outward to form a narrow inlet (40) and a wider outlet (42). Provided over the outlet (42) of the burner cone (38) is a diffuser plate (44). In the preferred embodiment the burner (38) and diffuser plate (44) are constructed of a ceramic material.

Figures 3, 4:
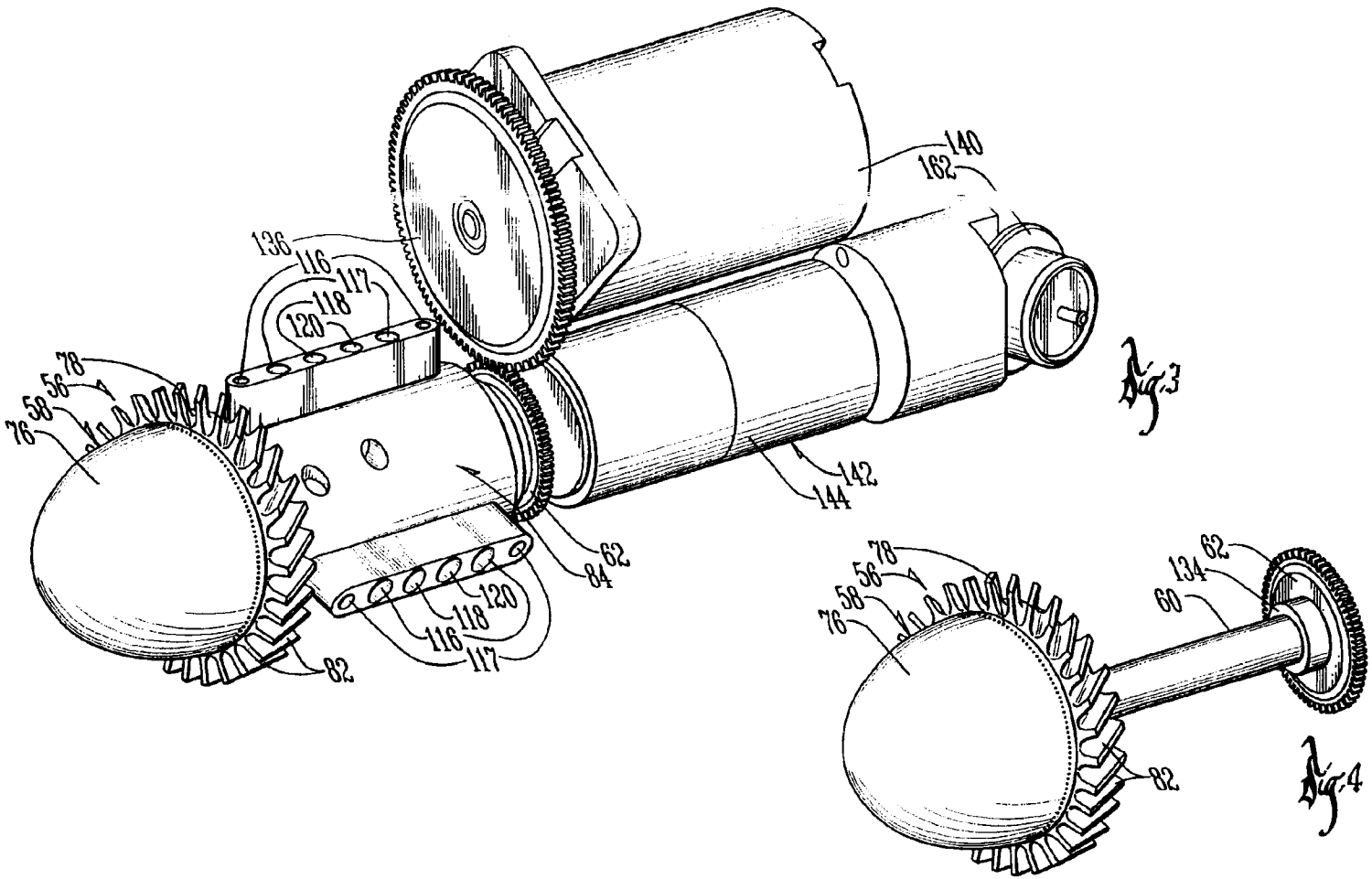
FIG. 3 illustrates the turbine assembly of the combustion heater of FIG. 1.
FIG. 4 illustrates the turbine, quill and quill gear of the combustion heater of claim 1.

As shown in FIG. 1, openings (46) and (48) are provided in the outer housing (30) and burner cone (38) respectively to accommodate a spark plug (50). The spark plug (50) is electrically coupled to a standard twelve-volt battery (52) by a spark plug wire (54). Provided within the burner cone (38) outer housing (30) and induction chamber (12) is a turbine assembly (56). As shown in FIG. 4, the turbine assembly includes a heat exchanger (58), a quill (60), and a gear (62). The gear (62) is welded or otherwise secured to the quill (60). The entire turbine assembly (56) is preferably constructed of stainless steel. As shown in FIG. 1, the quill (60) is provided with a hollow interior, defining a fluid passageway (64), having an inlet (66) and an outlet (68). A nozzle (70) is provided in fluid communication with the outlet (68) at its opposite end in fluid communication with a heating chamber (72). The heating chamber (72) is defined by an interior wall (74) of the heat exchanger (58). As shown in FIG. 4, the heat exchanger (58) is also provided with an exterior wall (76). The heat exchanger (58) is positioned within a combustion chamber (80) defined by the burner cone (38). The heat exchanger (58) is provided with a plurality of apertures (78) in fluid communication with both the heating chamber (72) and the combustion chamber (80).

As shown in FIG. 4, a plurality of propellers, which, in the preferred embodiment, are angled fins (82), are welded to the exterior wall (76) of the heat exchanger (58). The heat exchanger (58) is provided with fins (82), each having a width tapering from the connection point with the heat exchanger (58) to their terminus. The fins (82) are angled as shown in FIGS. 3 and 4.

As shown in FIG. 1, the turbine assembly (56) is journaled to a cooling jacket (84) by a pair of stainless steel bearings (86) and (88), provided with silicone seals (90) and (92). The bearings (86) and (88) couple the quill (60) to the cooling jacket (84), which defines a cooling chamber (94). Secured to the cooling jacket (84) is a stainless steel skirt (96) provided with a sleeve (98), within which is provided the quill (60). As shown in FIG. 1, an interior face (100) of the sleeve (98) is provided with a recess (102) extending all of the way around the quill (60), and in fluid communication with an outlet (104), coupled to the fluid passageway (64). As shown in FIG. 1, the heating chamber (72) is provided with a sufficient number of decoking balls (106) to cover an entire circumference of the heating chamber (72) as shown in FIG. 1. Preferably, the decoking balls (106) are constructed of stainless steel.

As shown in FIG. 1, the skirt (96) is provided with a side wall (108) in contact with the interior wall (74) of the heating chamber (72), and a lip (110) in contact with a rearward face (112) of the heat exchanger (58). The skirt (96) tapers inward and rearward from the lip (110) to a contact point with the cooling jacket (84). As shown in FIG. 3, three spacers (114) are secured to the cooling jacket (84) by bolts (116). As shown in FIG. 1, the spacers (114) are secured to the outer housing (30) by a plurality of bolts (117). The outer housing (30), spacers (114), and cooling jacket (84) are each provided with apertures in alignment which define three separate fluid inlets (118) and three separate fluid outlets (120). Both the fluid inlets (118) and fluid outlets (120) are in fluid communication with the cooling chamber (94). The bearings (86) and (88), and seals (90) and (92), coact to make the cooling chamber (94) a sealed system and prevent loss of a fluid (122) circulating through the cooling chamber (94). The fluid outlet (120) is coupled by an exhaust hose (124) to a heat exchanger (126), such as those well known in the art. The heat exchanger (126) is, in turn, connected by a transfer hose (128) to a fluid pump (130), which may be of any suitable type known in the art. The fluid pump (130) is coupled by a supply hose (132) to the fluid inlet (118).

As shown in FIG. 1, the gear (62) is provided with a er (134) to align the gear (62) with a drive gear (136). The drive gear (136) is coupled by a drive shaft (138) to a standard direct current motor (140). In the preferred embodiment, the drive gear (136) and drive shaft (138) are constructed of stainless steel, and the drive gear (136) is provided with more teeth than the gear (62) of the turbine assembly (56), thereby providing for a faster rotation of the turbine assembly (56) than the drive shaft (138). As shown in FIG. 1, the motor (140) is also connected to the battery (52).

As shown in FIG. 1, the turbine assembly (56) is coupled to a fuel assembly (142). The fuel assembly (142) includes a fuel housing (144) defining a fuel passageway (146) and a fuel chamber (148). The fuel chamber (148) is provided with an outlet (150). As shown in FIG. 1, the quill (60) extends though the outlet (150) and a seal (152) is provided around the quill (60) to prevent fluid escaping from the fuel chamber (148) through the outlet (150).

A fuel injector (154) is coupled to the fuel passageway (146). (FIG. 3). The fuel injector (154) is coupled by a fuel line (156) to a fuel tank (158). A fuel pressure regulator (162) is provided in communication with the fuel passageway (146).

To operate the combustion heater (10) of the present invention, the motor (140) is actuated to drive the drive gear (136) which, in turn, drives the gear (62) of the turbine assembly (56). As the turbine assembly (56) rotates, the fins (82) draw air from the induction chamber (12) through the flow chamber (32) and drive the air out of the combustion chamber (80) and through the diffuser plate (44). The fuel injector (56) is thereafter actuated to meter fuel (160) such as gasoline from the fuel tank (158) into the fuel passageway (146). Preferably, the fuel pressure regulator (162) is said to provide a predetermined fuel pressure within the fuel passageway (146). As the fuel passageway (146) fills, fuel (160) moves through the inlet (66) of the fluid passageway (64) of the quill (60). The fuel (160) thereafter passes through the outlet (68) of the quill (60) through the nozzle (70) and into the heating chamber (72). The fuel (160) moves through the heating chamber (72) and exits the heating chamber (72) trough the aperture (78). Due to the size of the apertures (78) and the high of the turbine assembly (56), the fuel (160) is divided into very fine particles as it exits the aperture (78). As the fuel exits the aperture (78), the walls of the aperture (78) actually shear the exiting fuel (160) into extremely fine particles. As the fuel (160) exists the aperture (78), the spinning fins (82) force oxygen between the particles of fuel (160) and begin mixing the fuel/oxygen mixture to substantially surround each particle of fuel (160) with an adequate supply of oxygen for combustion. As the fuel and oxygen mixture is pushed toward the diffuser plate (44) by the fins (82), the mixture becomes more homogenous.

Once the combustion chamber (80) is filled with a fuel/oxygen mixture, the spark plug (50) is actuated to generate a spark within the combustion chamber (80). Once the spark ignites the fuel/oxygen mixture, the resulting flame exits from the combustion chamber (80) through the diffuser plate (44). The diffuser plate (44) is provided with a plurality of apertures. A sufficient number of apertures is provided in the diffuser plate (44) to allow the combusting fuel/oxygen mixture to escape the combustion chamber (80), but few enough to generate a back pressure within the combustion chamber (80). The diffuser plate (44) provides back pressure for smooth ignition. As the fuel/oxygen mixture combusts within the combustion chamber (80), heat is generated which passes through the heat exchanger (58) and heats fuel (160) circulating within the heating chamber (72). In the preferred embodiment, the exterior wall (76) of the heat exchanger (58) is thick enough to allow for sufficient heat transmission into the heat exchanger (58) to preheat the fuel (160) in excess of 500 degrees Celsius and, more preferably to a temperature of 600 degrees Celsius, or more, before the fuel (160) exits the heat exchanger (58). Once combustion has begun, the damper (24) may be manipulated to increase or decease the flow of air rough the combustion heater (10). Additionally, the speed of the turbine assembly (56) can be adjusted to optimize the resulting flame exiting through the diffuser plate (44). In the preferred embodiment, a flame (166) exits the diffuser plate (44) and continues for only a short distance, and produces an efficient blue flame. Due to the preheating of the fuel, the shearing of the fuel upon exiting the heating chamber (72), the thorough mixing of the fuel/oxygen fixture and the backpressure combustion, the emerging flame (166) is a highly efficient, clean burning flame, which can be easily attenuated.

Occasionally, once the supply of fuel (160) to the heating chamber (72) is discontinued, a small amount of fuel (160) burns within the heating chamber (72) without a sufficient amount of oxygen to burn the fuel (160) completely. Accordingly, often specks of carbon and other waste (168) forms within the heating chamber (72). Accordingly, the plurality of decoking balls (106) is used to rid the heating chamber (72) of such waste (168). When the combustion heater (10) is restarted, the turbine assembly (56) turns, thereby circulating the decoking balls (106) within the heating chamber (72) and disbursing the waste (166) into smaller and smaller particles. Eventually, the rolling of the decoking balls (106) over the waste (168) grinds the waste (168) into pales small enough to pass through the apertures (78), provided in the exterior wall (76) of the heat exchanger (58). In this manner, the combustion heater (10) is self cleaning and moves its own waste (168) into the combustion chamber (80) where the waste (168) is burned and used to generate heat energy.

Although the invention has been described with respect to a preferred embodiment thereof, it to be also understood that it is not to be so limited, since changes and modifications can be made therein which are within the full intend scope of this invention as defined by the appended claims. For example, it should be noted that the combustion heater (10) may be constructed of any suitable size and may be used with any suitable fuel, and may be used with fuels which would otherwise be solid at room temperature, of which may be made sufficiently malleable by preheating or otherwise, and provided through the fluid passageway (64) to the heating chamber (72) and used to generate heat in the combustion chamber (80). It is additionally anticipated that the heat exchanger (58) may be of any suitable configuration and material construction, and that the heat exchanger (58) may be provided with any suitable propulsive means or that the propellers may be secured instead to the outer housing (30) or burner cone (38) and rotated in a direction opposite to the rotation of the heat exchanger (58), and may be positioned between the diffuser plate (44) and apertures (78) to more thoroughly shear and mix the fuel entering the combustion chamber (80).

What is claimed is:

1. A heater comprising:

(a) an induction chamber provided with an inlet;

(b) a combustion chamber in fluid communication with said inlet of said induction chamber;

(c) means for moving an oxidizer from said inlet of said induction chamber to said combustion chamber;

(d) a fuel reservoir;

(e) a frame defining a fuel passageway;

(f) means for moving a fuel from said fuel reservoir through said fuel passageway to said combustion chamber;

(g) means in fluid communication with said fuel passageway for shearing a fuel prior to combustion;

(h) means in fluid communication with said fuel passageway for heating a fuel prior to combustion; ad (i) means for combusting a fuel oxidizer mixture within said combustion chamber;

(j) means for maintaining an oxidizer afay from a fuel as said fuel is heated with said hearing means;

(k) wherein said hearing means is a shell in fluid communications with said fuel passageway and provided with means for allowing a heated fuel to excape from said shell;

(l) means for rotating said shell; and (m) a propeller secured to said shell.

2. The heater of claim 1, wherein said heating means is means for heating fuel to a temperature in excess of 500 degrees Celsius.

3. The heater of claim 1, wherein the said spinning means and propellers are operably coupled to said shell in a manner which forces a fluid coming into contact with said propeller over said shearing means.

4. A heater comprising:

(a) an induction chamber provided with an inlet;

(b) a combustion chamber in fluid communication with said inlet of said induction chamber;

(c) means for moving an oxidizer from said inlet of said induction chamber to said combustion chamber;

(d) a fuel reservoir;

(e) a frame defining a fuel passageway;

(f) means for moving a fuel from a said fuel reservoir through said fuel passageway to said combustion chamber;

(g) means in fluid communication with said fuel passageway for shearing a fuel prior to combustion;

(h) wherein said shearing means is a shear and means coupled to said shear for directing said shear across a first concentration of fuel having a first surface area in a manner which divides said first concentration of fuel into a second concentration of fuel having a second surface area, and a third concentration of fuel having a third surface area, wherein the total surface area of said second surface area and said third surface area is greater than said first surface area (i) means in fluid communication with said fuel passageway for hearing a fuel prior to combustion; and (j) means for combusting a fuel oxidizer mixture within said combustion chamber.

5. The heater of claim 4, wherein said heating means is a shell in fluid communication with said fuel passageway and wherein said shear is a perimeter of an aperture provided in said shell.

6. The heater of claim 5, wherein said moving means is a propeller secured to said shell.

7. A heater comprising:

(a) an induction chamber provided with an inlet;

(b) a combustion chamber in fluid communication with said inlet of said induction chamber;

(c) means for moving an oxidizer from said inlet of said induction chamber to said combustion chamber;

(d) a fuel reservoir;

(e) a frame defining a fuel passageway;

(f) means for moving a fuel from said fuel reservoir through said fuel passageway to said combustion chamber;

(g) means in fluid communication with said fuel passageway for shearing a fuel prior to combustion;

(h) means in fluid communication with said fuel passageway for heating a fuel prior to combustion; and (i) means for combusting a fuel oxidizer mixture within said combustion chamber;

(j) a hollow heat exchanger, secured for rotatable movement around an outlet of said fuel passageway; and (k) means provided within said heat exchanger for dividing waste material into particles sufficiently small to pass through an exhaust port of said heat exchanger.

8. The heater of claim 7, wherein said dividing means is a ball provided within said heat exchanger.

9. The heater of claim 7, wherein said heating chamber is provided with a plurality of outlets and wherein a plurality of balls are provided within said heat exchanger.

10. The heater of claim 9, wherein said heat exchanger is provided with in interior circumference, and wherein a sufficient number of balls are provided so as to substantially cover said circumference when said heat exchanger is rotated.

11. A heater comprising:

(a) an induction chamber having an inlet and an outlet;

(b) a combustion chamber having an inlet in fluid communication with said outlet of said induction chamber, said combustion chamber also being provided with an outlet;

(c) a heat exchanger comprising:

(i) an exterior shell defining an interior and an outlet;

(ii) means provided on said shell for shearing fuel;

(iii) means coupled to said exterior shell for propelling fluid as said heat exchanger is rotated;

(d) a fuel reservoir;

(e) a quill having a first end in fluid communication with said fluid reservoir, and a second end in fluid communication with said interior of said exterior shell of said heat exchanger;

(f) means coupled to said quill for regulating a flow of fuel through said quill;

(g) means for producing a back pressure within said combustion chamber;

(h) means for rotating said heat exchanger at a sufficient speed to draw a fluid into said induction chamber and into said combustion chamber; and (i) means for combusting a fuel within said combustion chamber.

12. The heater of claim 11, further comprising means for attenuating a flow of fluid into said inlet of said induction chamber.

13. The heater of claim 12, wherein said attenuating means is a damper.

14. The heater of claim 11, wherein said propelling means is a propeller secured to said exterior shell of said heat exchanger.

15. The heater of claim 11, wherein said backpressure producing means is a diffuser plate secured over at least a portion of said combustion chamber.

16. The heater of claim 11, wherein said combusting means is a spark plug in fluid communication with said combustion chamber.

17. The heater of claim 11, further comprising means for cooling said quill.

18. The heater of claim 17, wherein said cooling means is means for circulating a fluid around said quill.

19. The heater of claim 11, further comprising means provided within said heat exchanger for dividing waste material into particles sufficiently small to pass through said outlet of said heat exchanger.

20. The heater of claim 19, wherein said dividing means is a ball provided within said heat exchanger.

21. The heater of claim 20, wherein said heating chamber is provided with a plurality of outlets and wherein a plurality of balls are provided within said heat exchanger.

22. A combustion heating system comprising:

(a) an induction chamber having an inlet and an outlet;

(b) means for controlling a flow of fluid through said induction chamber;

(c) a combustion chamber having an inlet in fluid communication with said outlet of said induction chamber, said combustion chamber also being provided with an outlet;

(d) a diffuser secured over at least a portion of said outlet of said combustion chamber, (e) a turbine provided at least partially within said combustion chamber, said turbine comprising:

(i) a wall defining an interior cavity and provided with a sidewall defining an aperture through said wall and in fluid communication with said interior cavity;

(ii) a propeller secured to said wall, (f) a quill having an outlet in fluid communication with said interior cavity of said turbine, said quill also being provided with an inlet;

(g) a fuel reservoir in fluid communication with said inlet of said quill;

(h) means for regulating a flow of fluid through said quill;

(i) means for rotating said turbine at a sufficient speed to draw a fluid from said induction chamber into said combustion chamber, and to cause said sidewall of said wall of said turbine to shear a fuel exiting said turbine through said aperture; and (j) means in fluid communication with said combustion chamber for combusting a fluid oxidizer mixture within said combustion chamber.

* * * * *